US009960522B2

(12) United States Patent
Tada et al.

(10) Patent No.: US 9,960,522 B2
(45) Date of Patent: May 1, 2018

(54) CONNECTOR

(71) Applicant: Japan Aviation Electronics Industry, Limited, Tokyo (JP)

(72) Inventors: Takashi Tada, Tokyo (JP); Katsumi Arai, Tokyo (JP); Toshiyuki Shimoda, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days. days.

(21) Appl. No.: 15/678,832

(22) Filed: Aug. 16, 2017

(65) Prior Publication Data

US 2017/0346216 A1 Nov. 30, 2017

Related U.S. Application Data

(63) Continuation of application No. PCT/JP2016/053195, filed on Feb. 3, 2016.

(30) Foreign Application Priority Data

Apr. 10, 2015 (JP) ..... 2015-080758

(51) Int. Cl.

| | |
|---|---|
| ***H01R 12/00*** | (2006.01) |
| ***H01R 13/52*** | (2006.01) |
| ***H01R 12/70*** | (2011.01) |
| ***H01R 13/6585*** | (2011.01) |
| ***H01R 13/41*** | (2006.01) |

(52) U.S. Cl.

CPC ..... *H01R 13/5202* (2013.01); *H01R 12/707* (2013.01); *H01R 13/41* (2013.01); *H01R 13/521* (2013.01); *H01R 13/6585* (2013.01)

(58) Field of Classification Search

CPC ..... H01R 12/707; H01R 13/5202; H01R 13/6585; H01R 13/41; H01R 13/521

USPC ..... 439/83, 607.35, 607.36, 660

See application file for complete search history.

(56) References Cited

U.S. PATENT DOCUMENTS

| | | | | |
|---|---|---|---|---|
| 9,608,359 | B2 | 3/2017 | Arai et al. | |
| 9,812,809 | B2 * | 11/2017 | Arai | H01R 13/5213 |
| 9,847,595 | B2 * | 12/2017 | Tsai | H01R 13/521 |

(Continued)

FOREIGN PATENT DOCUMENTS

| | | | |
|---|---|---|---|
| CN | 203871583 | U | 10/2014 |
| JP | 2011-124147 | A | 6/2011 |
| JP | 5433776 | B1 | 3/2014 |

(Continued)

*Primary Examiner* — Khiem Nguyen

(74) *Attorney, Agent, or Firm* — Muncy, Geissler, Olds & Lowe, P.C.

(57) ABSTRACT

A connector includes a first insulator, contacts joined to the first insulator, a contact insulator integrally holding the contacts in a vicinity of rear end portions thereof, a ground plate which extends along the contacts, a metal peripheral shell placed over the first insulator so as to surround a periphery of front end portions of the contacts and a front end portion of the ground plate and electrically connected to the ground plate, and a second insulator that is formed so as to cover a rear part of the first insulator, a rear part of the peripheral shell, central parts of the contacts and a central part of the ground plate, with the rear end portions of the contacts, the contact insulator and a rear end portion of the ground plate being exposed.

10 Claims, 6 Drawing Sheets

(56) References Cited

U.S. PATENT DOCUMENTS

| | | | | |
|---|---|---|---|---|
| 9,853,393 | B2 * | 12/2017 | Guo | H01R 13/405 |
| 2015/0333435 | A1 | 11/2015 | Arai et al. | |

FOREIGN PATENT DOCUMENTS

| | | | |
|---|---|---|---|
| JP | 2014-186819 | A | 10/2014 |
| WO | WO 2014/091931 | A1 | 6/2014 |

* cited by examiner

CONNECTOR

BACKGROUND OF THE INVENTION

The present invention relates to a connector, particularly to a connector having a plurality of contacts and a shell.

In recent years, portable electronic devices have been widely used. Such electronic devices are made thinner and required to have an excellent waterproof function. Accordingly, connectors for use in electronic devices are also required to be thin and have waterproof properties.

In addition, to prevent transmitted electric signals from being affected by electromagnetic waves from outside, the development of connectors shielded against electromagnetic waves is in progress.

Such a connector having both waterproof properties and electromagnetic wave shielding properties is disclosed in, for instance, JP 5433776 B. This connector has the configuration in which a housing 1 made of an insulating material is molded integrally with a cylindrical shell 2 made of metal and contacts 3 for use in establishing conductive connection, as shown in FIG. 17. A counter connector accommodating portion 4 for accommodating a counter connector is formed in the shell 2, and each of the contacts 3 is formed at its one end with a contact section 3A exposed in the counter connector accommodating portion 4 to come into contact with a contact of the counter connector and at its other end with a board connecting section 3B projecting from the back part of the housing 1 to be connected to a board 5 of an electronic device.

An opening 7 is formed in a casing 6 of the electronic device, and a gasket 8 is disposed along the periphery of the opening 7 to seal between an inner surface of the casing 6 and the front surface of the housing 1 of the connector.

Covering the contact sections 3A of the contacts 3 by the shell 2 brings about a shielding effect against electromagnetic waves, while molding the housing 1 integrally with the shell 2 and the contacts 3 and disposing the gasket 8 between the inner surface of the casing 6 and the front surface of the housing 1 result in preventing water from entering through the counter connector accommodating portion 4 to the inside of the electronic device where the board 5 lies.

However, there has been a problem that since the housing 1 made of an insulating material is molded so as to cover the periphery of the shell 2, the overall size of the connector, particularly, the thickness of the connector becomes large.

In addition, in an attempt to miniaturize the connector having a large number of contacts, reduction of each of the contacts in size and reduction in the arrangement pitch of the contacts are required, and it may cause deformation or misalignment of the contacts due to injection pressure of a molten resin in molding the housing.

SUMMARY OF THE INVENTION

The present invention has been made to eliminate the conventional drawback as above and is aimed at providing a thin and high-precision connector that can reduce the influence of electromagnetic waves and can improve waterproof properties.

A connector according to the present invention that is mounted on a board and that has a counter connector accommodating portion opening frontward in a fitting direction, the connector comprises:

a first insulator whose front part is located in the counter connector accommodating portion and whose rear part is located at a rear part of the counter connector accommodating portion;

a plurality of contacts that are joined to the first insulator such that front end portions of the plurality of contacts are exposed at a front part of the first insulator and rear end portions of the plurality of contacts project from the rear part of the first insulator;

a contact insulator that integrally holds the plurality of contacts in a vicinity of the rear end portions thereof;

a ground plate whose front end portion is disposed on a surface of the first insulator in the counter connector accommodating portion, and which extends along the plurality of contacts such that a rear end portion of the ground plate is disposed on a surface of the contact insulator and is connected to the board;

a peripheral shell that is made of metal, that is placed over the first insulator so as to surround a periphery of the front end portions of the plurality of contacts and the front end portion of the ground plate, and that is electrically connected to the ground plate; and a second insulator that is formed so as to cover the rear part of the first insulator, a rear part of the peripheral shell, central parts of the plurality of contacts and a central part of the ground plate, with the rear end portions of the plurality of contacts, the contact insulator and the rear end portion of the ground plate being exposed.

DETAILED DESCRIPTION OF THE INVENTION

An embodiment of the present invention is described below based on the appended drawings.

Figure 1:
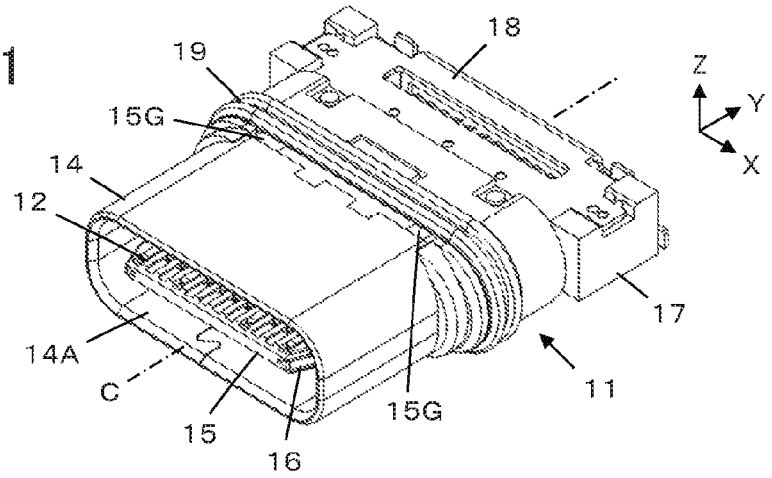
FIG. 1 is a perspective view showing a connector according to an embodiment of the present invention when viewed obliquely from above.
Figure 2:
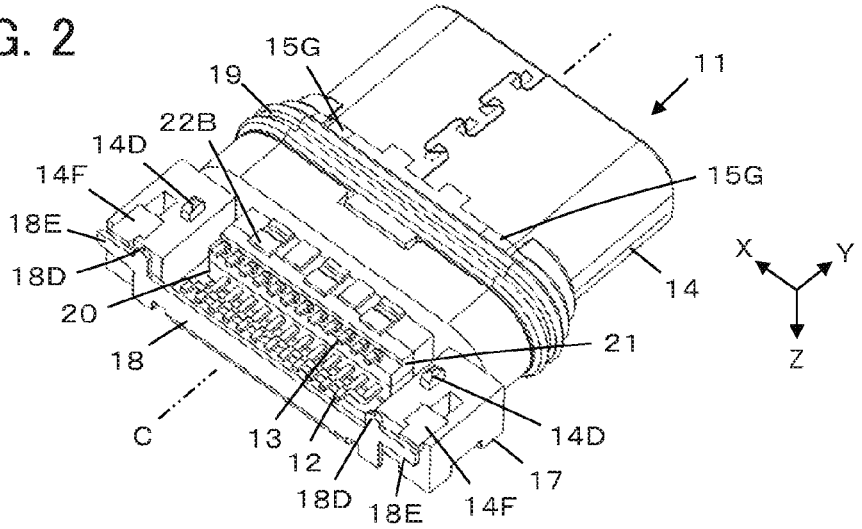
FIG. 2 is a perspective view showing the connector according to the embodiment when viewed obliquely from below.

FIGS. 1 and 2 show a connector 11 according to the embodiment. This connector 11 is a receptacle connector to be fixed to a board in an electronic device such as a portable device or an information device, and includes a plurality of first contacts 12 each of which extends in a direction of a fitting axis C and which are arranged in a direction orthogonal to the fitting axis C and a plurality of second contacts 13 each of which extends in the direction of the fitting axis C and which are arranged parallel to the first contacts 12.

A peripheral shell 14 in a flattened tubular shape which is made of metal and which extends along the fitting axis C is disposed so as to cover the periphery of front parts in the fitting axis C of the first contacts 12 and second contacts 13, and, inside the peripheral shell 14, a counter connector accommodating portion 14A to which a counter connector (not shown) is inserted is formed. The counter connector accommodating portion 14A accommodates a first insulator 15 made of an insulating resin, and central portions in the Y direction of the first contacts 12 and second contacts 13 are held by the first insulator 15, while a mid-plate 16 made of metal is embedded in the first insulator 15 and disposed between the first contacts 12 and the second contacts 13.

A second insulator 17 made of an insulating resin is formed so as to close a rear end portion in the fitting axis C direction of the peripheral shell 14, and a back shell 18 made of metal is disposed at the rear end portion of the second insulator 17 so as to cover back parts of the first contacts 12 and second contacts 13.

A waterproof member 19 is disposed at the periphery of the second insulator 17.

For convenience, a direction from front to back of the connector 11 along the fitting axis C is called "Y direction," an arrangement direction of the first contacts 12 and second contacts 13 "X direction," and a direction perpendicular to an XY plane and extending from the second contacts 13 to the first contacts 12 "Z direction."

Figure 3:
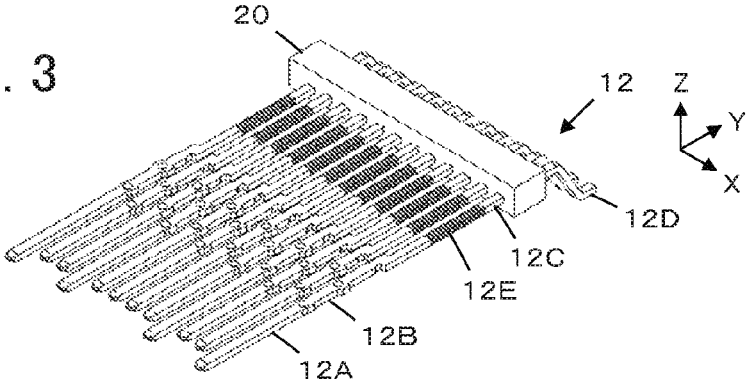
FIG. 3 is a perspective view showing a plurality of first contacts and a first-contact insulator used in the connector according to the embodiment.

As shown in FIG. 3, each of the first contacts 12 is composed of a plate-like member that extends in the Y direction and has a contact section 12A at the −Y directional end of the first contact 12, which contact section 12A is to be exposed in the counter connector accommodating portion 14A; a press-fit section 12B adjacent to the contact section 12A on the +Y directional side, which press-fit section 12B is to be pressed into the first insulator 15; a fixing section 12C adjacent to the press-fit section 12B on the +Y directional side, which fixing section 12C is to be fixed to the second insulator 17; and a contact-side board connecting section 12D at the +Y directional end of the first contact 12, which contact-side board connecting section 12D is to be connected to a board (not shown). The press-fit section 12B is provided with protrusions protruding in the X direction, and the fixing section 12C has, around its surface, a contact-side waterproof shaped section 12E to block the entry of water along the interface between the fixing section 12C and the second insulator 17.

A first-contact insulator 20 made of an insulating resin is formed between the fixing sections 12C and the contact-side board connecting sections 12D of the first contacts 12, and the first contacts 12 are integrally held by the first-contact insulator 20.

Figure 4:
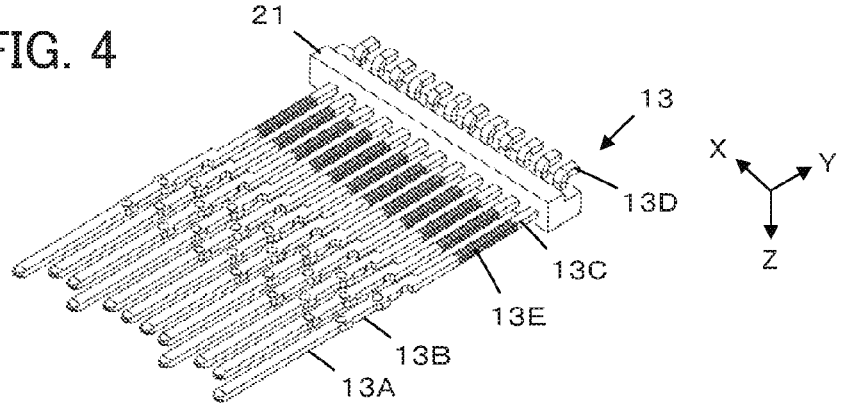
FIG. 4 is a perspective view showing a plurality of second contacts and a second-contact insulator used in the connector according to the embodiment.

As shown in FIG. 4, similarly, each of the second contacts 13 is composed of a plate-like member that extends in the Y direction and has a contact section 13A at the −Y directional end of the second contact 13, which contact section 13A is to be exposed in the counter connector accommodating portion 14A; a press-fit section 13B adjacent to the contact section 13A on the +Y directional side, which press-fit section 13B is to be pressed into the first insulator 15; a fixing section 13C adjacent to the press-fit section 13B on the +Y directional side, which fixing section 13C is to be fixed to the second insulator 17; and a contact-side board connecting section 13D adjacent to the fixing section 13C at the +Y directional end of the second contact 13, which contact-side board connecting section 13D is to be connected to the board (not shown). The press-fit section 13B is provided with protrusions protruding in the X direction, and the fixing section 13C has, around its surface, a contact-side waterproof shaped section 13E to block the entry of water along the interface between the fixing section 13C and the second insulator 17.

A second-contact insulator 21 made of an insulating resin is formed between the fixing sections 13C and the contact-side board connecting sections 13D of the second contacts 13, and the second contacts 13 are integrally held by the second-contact insulator 21.

The contact-side waterproof shaped sections 12E and 13E are each composed of a plurality of grooves or a plurality of protrusions surrounding and enclosing the periphery of the fixing section 12C or 13 of the associated first contact 12 or second contact 13.

Figure 5:
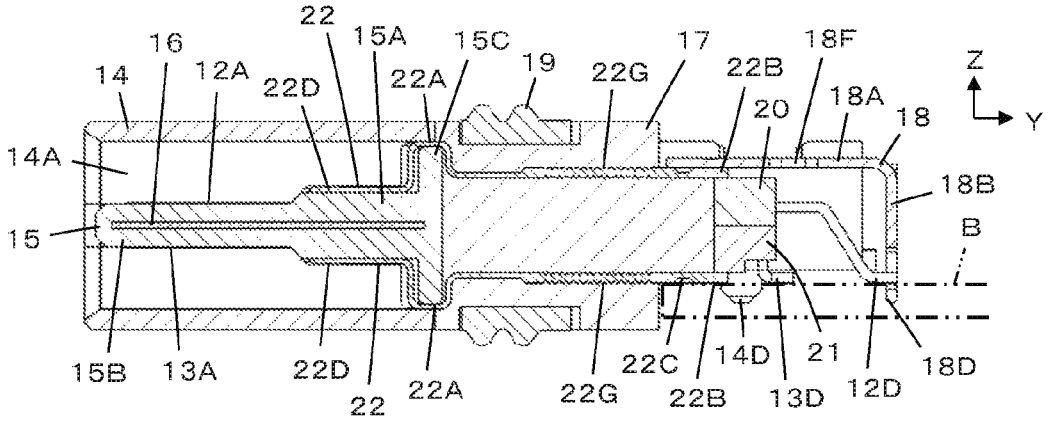
FIG. 5 is a sectional side view showing the connector according to the embodiment.

As illustrated in FIG. 5, the first insulator 15 has an insulator body 15A, a tongue-like section 15B extending from the insulator body 15A in the −Y direction along the fitting axis C, and a wall-like section 15C projecting in the +Z direction and the −Z direction from the +Y directional end of the insulator body 15A, and the contact sections 12A of the first contacts 12 and the contact sections 13A of the second contacts 13 extend in the −Y direction along opposite surfaces of the tongue-like section 15B and are exposed in the counter connector accommodating portion 14A.

The second insulator 17 is disposed so as to cover the rear part of the insulator body 15A. At the back part of the second insulator 17, the first-contact insulator 20 and the second-contact insulator 21 as well as the contact-side board connecting sections 12D of the first contacts 12 and the contact-side board connecting sections 13D of the second contacts 13 are exposed. The second insulator 17 is integrally formed with the fixing sections 12C of the first contacts 12 and the fixing sections 13C of the second contacts 13, whereby the first contacts 12 and the second contacts 13 are fixed to the second insulator 17.

In addition, a ground plate 22 made of metal is disposed on the surfaces facing the +Z direction of the first insulator 15 and second insulator 17. The ground plate 22 extends in the +Y direction from the surface of the insulator body 15A of the first insulator 15 so as to run over the wall-like section 15C, and a shell connecting section 22A located on the +Z directional end of the wall-like section 15C is connected to an inner surface on the +Z directional side of the peripheral shell 14.

Similarly, another ground plate 22 made of metal is disposed on the surfaces facing the −Z direction of the first insulator 15 and second insulator 17. The ground plate 22 on the −Z directional side has the same configuration as that of the ground plate 22 on the +Z directional side but is reversed to the ground plate 22 on the +Z directional side along the Z direction. That is, the ground plate 22 on the −Z directional side also extends in the +Y direction from the surface of the insulator body 15A of the first insulator 15 so as to run over the wall-like section 15C, and a shell connecting section 22A located on the −Z directional end of the wall-like section 15C is connected to an inner surface on the −Z directional side of the peripheral shell 14.

The ground plate 22 disposed on the surfaces facing the +Z direction of the first insulator 15 and second insulator 17 extends from the −Y direction to the +Y direction along the first contacts 12, and the +Y directional end 22B of the ground plate 22 projects rearward of the second insulator 17 to be disposed on the surface facing the +Z direction of the first-contact insulator 20 and is connected to the back shell 18.

Similarly, the other ground plate 22 disposed on the surfaces facing the −Z direction of the first insulator 15 and second insulator 17 extends from the −Y direction to the +Y direction along the second contacts 13, and the +Y directional end 22B of the other ground plate 22 projects rearward of the second insulator 17 to be disposed on the surface facing the −Z direction of the second-contact insulator 21.

In addition, the other ground plate 22 disposed on the −Z directional side projects rearward of the second insulator 17 and is provided with a recess 22C facing the −Z direction and located in front of the second-contact insulator 21 in the fitting direction, i.e., on the −Y directional side with respect to the second-contact insulator 21, and the recess 22C constitutes a second ground plate-side board connecting section that is connected to a board B on which the connector 11 is to be mounted.

Moreover, a waterproof member 19 is disposed so as to surround the periphery of a portion of the second insulator 17, which portion is located rearward in the fitting direction of, i.e., on the +Y directional side with respect to, the shell connecting sections 22A of the ground plates 22 on the +Z directional side and on the −Z directional side.

Figure 6:
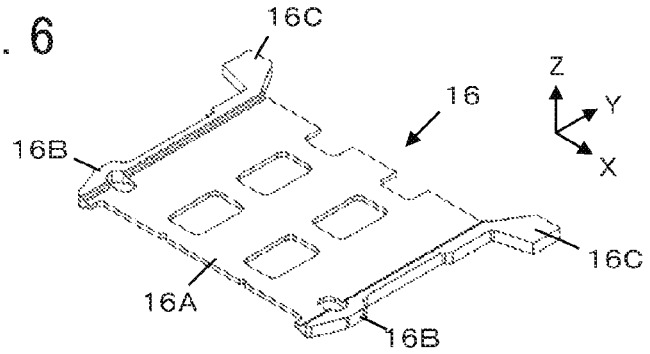
FIG. 6 is a perspective view showing a mid-plate used in the connector according to the embodiment.

As shown in FIG. 6, the mid-plate 16 has a flat plate section 16A extending along an XY plane. At the +X and −X directional ends on the −Y directional side of the flat plate section 16A, counter connector connecting sections 16B are individually formed, while at the +X and −X directional ends on the +Y directional side of the flat plate section 16A, ground plate connecting sections 16C are individually formed so as to project in the X direction.

Figure 7:
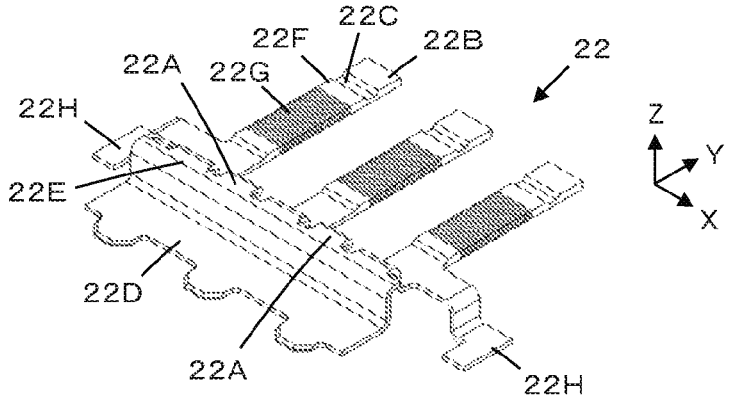
FIG. 7 is a perspective view showing a ground plate used in the connector according to the embodiment.

As shown in FIG. 7, the ground plate 22 disposed on the +Z directional side includes a ground plate body 22D in a flat plate shape facing the press-fit sections 12B of all of the first contacts 12 on the +Z directional side via the first insulator 15, which first contacts 12 are arranged in the X direction; and a raised section 22E bending from the +Y directional end of the ground plate body 22D toward the +Z direction and extending parallel to the ground plate body 22D. In the raised section 22E, two shell connecting sections 22A are disposed.

The +Y directional side of the raised section 22E bends toward the −Z direction, and three arm sections 22F extend therefrom in the +Y direction along the XY plane. A tip end in the +Y direction of each of the arm sections 22F constitutes a +Y directional end 22B of the ground plate 22, and a recess 22C opening toward the +Z direction is formed near the +Y directional end 22B and on the −Y directional side with respect to the +Y directional end 22B.

In addition, around a surface of a portion, on the −Y directional side with respect to the recess 22C, of each of the arm sections 22F, a ground plate-side waterproof shaped section 22G is formed to block the entry of water along the interface between the arm section 22F and the second insulator 17. The ground plate-side waterproof shaped sections 22G are each composed of a plurality of grooves or protrusions surrounding and enclosing the periphery of the associated arm section 22F.

Among the three arm sections 22F, the one located farthest in the +X direction has a mid-plate connecting section 22H coupled to a root portion of this arm section 22F, projecting from the root portion in the +X direction and in the −Z direction and extending along the XY plane. Similarly, among the three arm sections 22F, the one located farthest in the −X direction has a mid-plate connecting section 22H coupled to a root portion of this arm section 22F, projecting from the root portion in the −X direction and in the −Z direction and extending along the XY plane.

A surface facing the +Z direction of the ground plate body 22D is exposed in the counter-connector accommodating portion 14A of the peripheral shell 14 and, when the connector 11 is fitted with a counter connector, comes into contact with a grounding spring contact of the counter connector.

While the ground plate 22 disposed on the −Z directional side also has the same configuration as that of the ground plate 22 disposed on the +Z directional side shown in FIG. 7, the ground plate 22 on the −Z directional side is reversed to the ground plate 22 on the +Z directional side along the Z direction such that the shell connecting section 22A faces the −Z direction.

Figure 8:
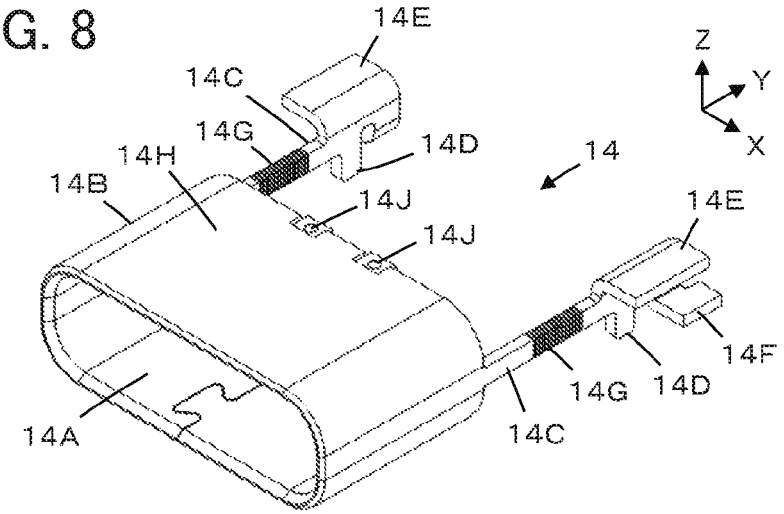
FIG. 8 is a perspective view showing a peripheral shell used in the connector according to the embodiment.

As illustrated in FIG. 8, a front end portion, i.e., a portion on the −Y directional side, of the peripheral shell 14 forms a flattened tubular section 14B, inside which the counter connector accommodating portion 14A is formed. At the +Y directional end of the tubular section 14B, a pair of arm sections 14C are formed so as to extend in the +Y direction along a YZ plane individually from the +X directional end and the −X directional end, and at the +Y directional end of each of the arm sections 14C, provided are a shell-side board connecting section 14D extending in the −Z direction, a back shell connecting section 14E extending along the XY plane and a projection 14F located away from the back shell connecting section 14E in the −Z direction and extending along the XY plane. A shell-side waterproof shaped section 14G is formed around the surface of each of the arm sections 14C to block the entry of water along the interface between the arm section 14C and the second insulator 17. The shell-side waterproof shaped section 14G is composed of a plurality of grooves or protrusions surrounding and enclosing the periphery of the associated arm section 14C.

The tubular section 14B has a pair of flat shell outer surfaces 14H extending along the XY plane and facing opposite directions from each other, and two ground plate connecting sections 14J are provided in a central portion at the +Y directional end of each of the shell outer surface 14H facing the +Z direction and the shell outer surface 14H facing the −Z direction. The ground plate connecting sections 14J are formed through a process of thinning the thickness of a metal sheet that constitutes the tubular section 14B.

Figure 9:
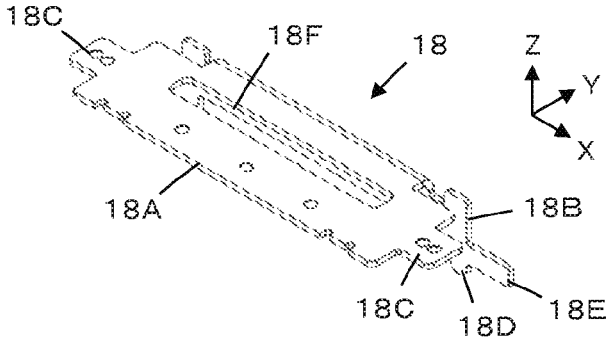
FIG. 9 is a perspective view showing a back shell used in the connector according to the embodiment.

As illustrated in FIG. 9, the back shell 18 has an upper surface section 18A in a flat plate shape extending along the XY plane and a rear surface section 18B in a flat plate shape bending from the +Y directional end of the upper surface section 18A in the −Z direction and extending along the XZ plane, and peripheral shell connecting sections 18C projecting along the XY plane are individually formed at the +X directional end and −X directional end of the upper surface section 18A, while shell-side board connecting sections 18D projecting in the −Z direction along the XZ plane are individually formed at the +X directional end and −X directional end of the rear surface section 18B. In addition, at the +X directional end and −X directional end of the rear surface section 18B, respectively provided are a projection 18E projecting in the +X direction and a projection 18E projecting in the −X direction along the XZ plane.

In the upper surface section 18A, an opening 18F extending in the +X direction is formed.

Figure 10:
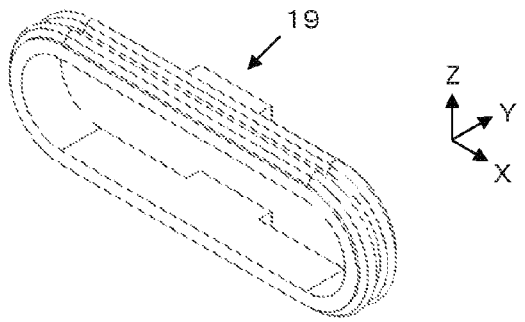
FIG. 10 is a perspective view showing a waterproof member used in the connector according to the embodiment.

As illustrated in FIG. 10, the waterproof member 19 is made of an elastic material such as rubber and has a seamless ring-like shape.

Next, a production method of the connector 11 according to the embodiment will be described.

As illustrated in FIG. 3, the first-contact insulator 20 made of an insulating resin is formed between the fixing sections 12C and the contact-side board connecting sections 12D of the first contacts 12, whereby the first contacts 12 are integrally held by the first-contact insulator 20.

Similarly, as illustrated in FIG. 4, the second-contact insulator 21 made of an insulating resin is formed between the fixing sections 13C and the contact-side board connecting sections 13D of the second contacts 13, whereby the second contacts 13 are integrally held by the second-contact insulator 21.

Figure 11:
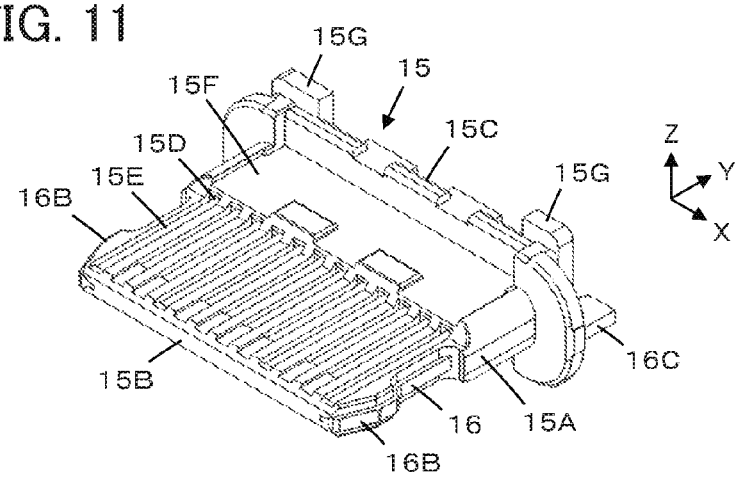
FIG. 11 is a perspective view showing a first insulator by which the mid-plate is held.

Next, the mid-plate 16 is disposed inside a mold (not shown), and a molten resin is poured into the mold, whereby the first insulator 15 in which the mid-plate 16 is embedded is formed as illustrated in FIG. 11.

In this process, the flat plate section 16A of the mid-plate 16 is embedded in the tongue-like section 15B of the first insulator 15, while the counter connector connecting sections 16B of the mid-plate 16 are exposed from the tongue-like section 15B of the first insulator 15 toward the +X direction and the −X direction, and the pair of ground plate connecting sections 16C of the mid-plate 16 project from the rear face of the first insulator 15 in the +Y direction.

The insulator body 15A of the first insulator 15 is provided with a plurality of through-holes 15D into which the first contacts 12 and second contacts 13 are to be pressed, and on surfaces facing the +Z direction and the −Z direction of the tongue-like section 15B, formed are a plurality of contact grooves 15E that are to be connected to the associated through-holes 15D and that extend in the Y direction.

Further, in the insulator body 15A of the first insulator 15, flat surfaces 15F facing the +Z direction and the −Z direction are formed at positions corresponding to the through-holes 15D.

The wall-like section 15C of the first insulator 15 projects from the +Y directional end of the insulator body 15A in the +X and −X directions as well as in the +Z and −Z directions along the XZ plane, and projections 15G are individually formed behind the wall-like section 15C, i.e., on the +Y directional side with respect to the wall-like section 15C at the +X directional end and the −X directional end so as to project farther than the wall-like section 15C in the +Z direction and the −Z direction.

Figure 12:
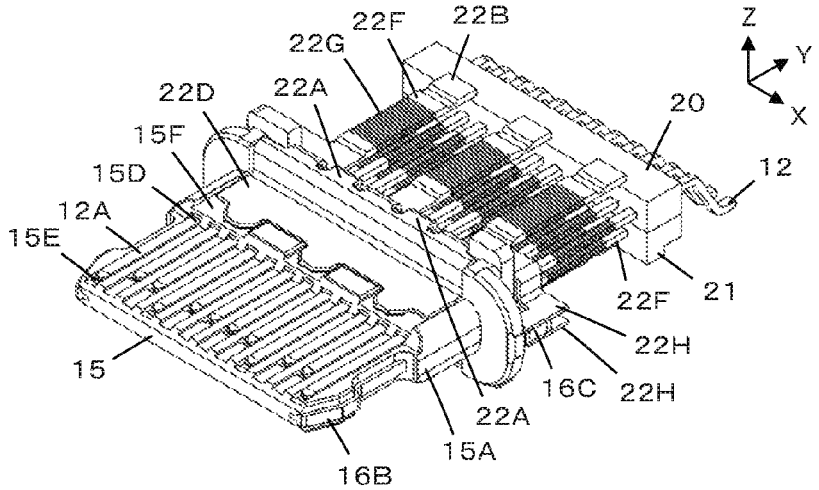
FIG. 12 is a perspective view showing the first insulator to which the first contacts and the second contacts are joined and to which a first ground plate and a second ground plate are attached.

As illustrated in FIG. 12, the press-fit sections 12B of the first contacts 12 and the press-fit sections 13B of the second contacts 13 shown in FIGS. 3 and 4 are pressed into the through-holes 15D formed in the first insulator 15, whereby the first contacts 12 and the second contacts 13 are joined to the first insulator 15. Here, since the first contacts 12 are integrally held by the first-contact insulator 20 and the second contacts 13 are integrally held by the second-contact insulator 21, the press-fitting process can be efficiently and accurately carried out. The first-contact insulator 20 and the second-contact insulator 21 are disposed so as to be overlapped on each other in the Z direction.

The contact sections 12A of the first contacts 12 and the contact sections 13A of the second contacts 13 are inserted into the associated contact grooves 15E of the first insulator 15.

Moreover, the ground plate 22 on the +Z directional side is disposed on the first insulator 15 such that the ground plate body 22D is located on the flat surface 15F on the +Z directional side of the first insulator 15, while the other ground plate 22 on the −Z directional side is disposed on the first insulator 15 such that the ground plate body 22D is located on the flat surface 15F on the −Z directional side of the first insulator 15.

In this state, the shell connecting sections 22A of the ground plate 22 on the +Z directional side are located on the +Z directional end of the wall-like section 15C of the first insulator 15, and the +Y directional ends 22B of the three arm sections 22F extending in the +Y direction come into contact with the surface facing the +Z direction of the first-contact insulator 20.

Similarly, the shell connecting sections 22A of the ground plate 22 on the −Z directional side are located on the −Z directional end of the wall-like section 15C of the first insulator 15, and the +Y directional ends 22B of the three arm sections 22F extending in the +Y direction come into contact with the surface facing the −Z direction of the second-contact insulator 21.

In addition, the pair of mid-plate connecting sections 22H of the ground plate 22 on the +Z directional side are individually located on surfaces facing the +Z direction of the corresponding ground plate connecting sections 16C of the mid-plate 16, while the pair of mid-plate connecting sections 22H of the ground plate 22 on the −Z directional side are individually located on surfaces facing the −Z direction of the corresponding ground plate connecting sections 16C of the mid-plate 16.

Figure 13:
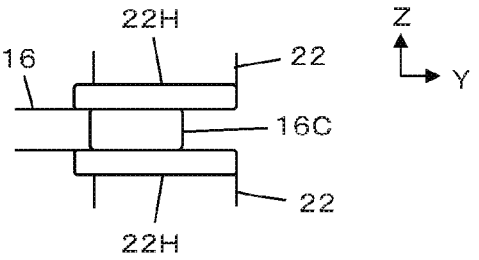
FIG. 13 is a partial side view showing a connecting section connecting the mid-plate to the first ground plate and the second ground plate.

FIG. 13 shows the one, on the +X directional side, of the pair of ground plate connecting sections 16C of the mid-plate 16 with the corresponding mid-plate connecting section 22H of the ground plate 22 on the +Z directional side and the corresponding mid-plate connecting section 22H of the ground plate 22 on the −Z directional side being located on opposite surfaces in the Z direction of the ground plate connecting section 16C.

In this state, the mid-plate connecting sections 22H of the two ground plates 22 are welded to the ground plate connecting section 16C of the mid-plate 16 using, for example, laser welding, whereby the mid-plate 16 is connected to the ground plate 22 on the +Z directional side and to the ground plate 22 on the −Z directional side.

Figure 14:
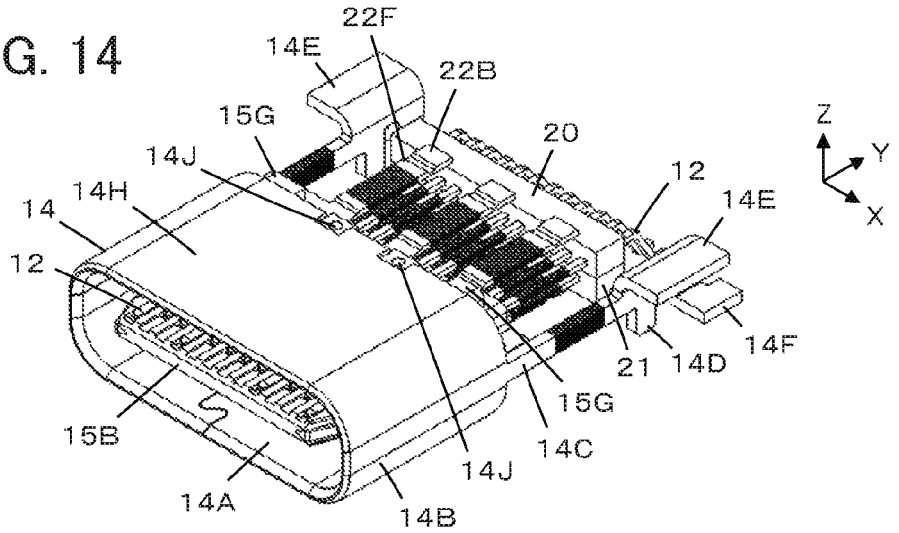
FIG. 14 is a perspective view showing the peripheral shell placed over the first insulator.

Next, as illustrated in FIG. 14, the tongue-like section 15B of the first insulator 15 is inserted into the counter connector accommodating portion 14A in the tubular section 14B of the peripheral shell 14, and the peripheral shell 14 is placed over the periphery of the first insulator 15 from the −Y directional side such that the +Y directional end of the tubular section 14B abuts the pair of projections 15G of the first insulator 15. In this process, the wall-like section 15C of the first insulator 15 is inserted into the +Y directional end portion of the tubular section 14B of the peripheral shell 14, and the two ground plate connecting sections 14J on the +Z directional side of the peripheral shell 14 individually come into contact with the pair of shell connecting sections 22A of the ground plate 22 disposed on the +Z directional side, while the two ground plate connecting sections 14J on the −Z directional side of the peripheral shell 14 individually come into contact with the pair of shell connecting sections 22A of the ground plate 22 disposed on the −Z directional side.

Then, the ground plate connecting sections 14J of the peripheral shell 14 are each irradiated with, for example, a laser beam from the +Z directional side or the −Z directional side to be welded to the shell connecting sections 22A of the ground plates 22, whereby the peripheral shell 14 is connected to the ground plates 22.

Each of the +Z directional ends and the −Z directional ends of the pair of projections 15G of the first insulator 15 forms a substantially same plane with the corresponding shell outer surface 14H of the tubular section 14B of the peripheral shell 14.

Figure 15:
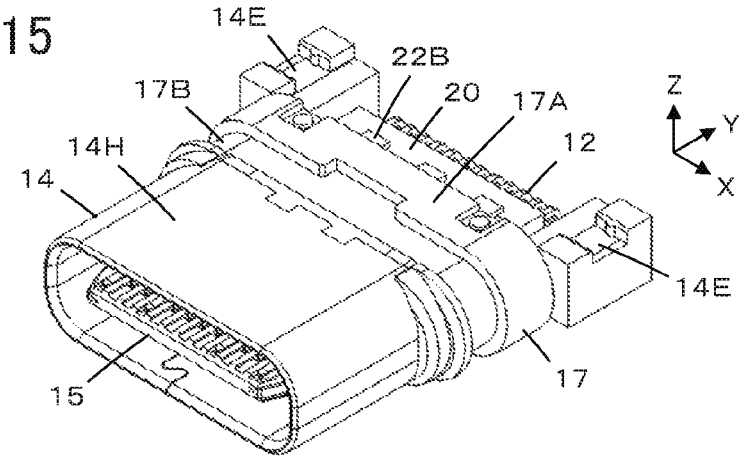
FIG. 15 is a perspective view showing the second insulator formed at a rear part of the first insulator.

Thereafter, the first insulator 15 to which the first contacts 12 and the second contacts 13 are joined, to which the pair of ground plates 22 are disposed, and over which the peripheral shell 14 is placed as above is disposed inside a mold (not shown), and a molten resin is poured into the mold, whereby the second insulator 17 that covers the rear part of the first insulator 15 and the rear part of the peripheral shell 14 is formed as illustrated in FIG. 15. Accordingly, the fixing sections 12C of the first contacts 12 and the fixing sections 13C of the second contacts 13, the three arm sections 22F of each of the ground plates 22, and the pair of arm sections 14C of the peripheral shell 14 are embedded in and fixed by the second insulator 17.

Here, the second insulator 17 can be formed while the pair of projections 15G of the first insulator 15, the first-contact insulator 20, the second-contact insulator 21, the back shell connecting sections 14E and the projections 14F of the peripheral shell 14 hold the mold.

Since the first contacts 12 are integrally held by the first-contact insulator 20 and the second contacts 13 are integrally held by the second-contact insulator 21, the first contacts 12 and the second contacts 13 are prevented from being displaced or deformed when being applied with an injection pressure of the molten resin in the mold.

In addition, since the +Y directional ends 22B of the three arm sections 22F of the ground plate 22 on the +Z directional side are disposed so as to contact with the surface facing the +Z direction of the first-contact insulator 20, while the +Y directional ends 22B of the three arm sections 22F of the ground plate 22 on the −Z directional side are disposed so as to contact with the surface facing the −Z direction of the second-contact insulator 21, the two ground plates 22 are prevented from being deformed even when being pushed by a surface of the mold and being applied with an injection pressure of the molten resin.

In the meantime, the first-contact insulator 20, the second-contact insulator 21, the +Y directional ends 22B of the arm sections 22F of the two ground plates 22 and a part of each of the back shell connecting sections 14E of the peripheral shell 14 are not covered by the second insulator 17 but are exposed.

Moreover, the second insulator 17 includes a pair of flat insulator outer surfaces 17A each of which forms a substantially same plane with the corresponding shell outer surface 14H of the peripheral shell 14, and an annular waterproof member groove 17B is provided at the periphery of the peripheral shell 14 including the insulator outer surfaces 17A.

Figure 16:
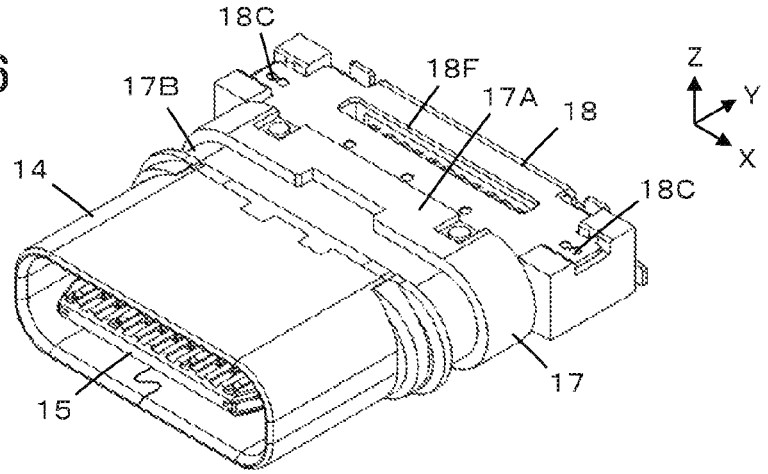
FIG. 16 is a perspective view showing the back shell attached to a rear part of the second insulator.
Figure 17:
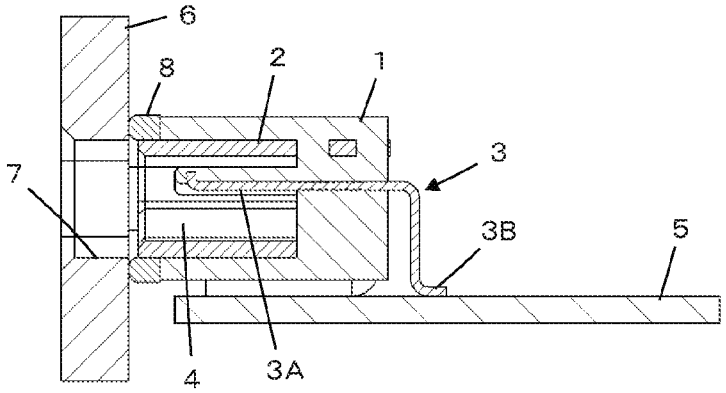
FIG. 17 PRIOR ART
FIG. 17 is a sectional side view of a conventional connector.

As illustrated in FIG. 16, when the back shell 18 is disposed at the rear part of the second insulator 17, the −Y directional end of the upper surface section 18A of the back shell 18 is overlapped on the +Y directional ends 22B of the three arm sections 22F of the ground plate 22 on the +Z directional side, which +Y directional ends 22B are exposed from the second insulator 17, and the pair of peripheral shell connecting sections 18C of the back shell 18 are overlapped on the back shell connecting sections 14E of the peripheral shell 14, which back shell connecting sections 14E are exposed from the second insulator 17.

In this state, the back shell 18 is irradiated with a laser beam, whereby the upper surface section 18A of the back shell 18 is welded to the +Y directional ends 22B of the three arm sections 22F of the ground plate 22 on the +Z directional side, and the pair of peripheral shell connecting sections 18C of the back shell 18 are individually welded to the back shell connecting sections 14E of the peripheral shell 14.

In this manner, the back shell 18 is connected to the ground plate 22 on the +Z directional side and the peripheral shell 14.

As illustrated in FIG. 2, since the pair of projections 18E projecting from the +X directional end and the −X directional end of the back shell 18 come into contact with the −Y directional ends of the pair of projections 14F of the peripheral shell 14, which pair of projections 14F are exposed toward the −Z direction from the second insulator 17, the projections 18E of the back shell 18 can also be connected to the projections 14F of the peripheral shell 14 through welding.

The mid-plate 16, the pair of ground plates 22, the peripheral shell 14 and the back shell 18 are electrically connected to one another in this manner.

Furthermore, by fitting the annular waterproof member 19 into the waterproof member groove 17B provided at the periphery of the second insulator 17, the connector 11 as illustrated in FIGS. 1 and 2 is manufactured.

As described above, since the second insulator 17 formed so as to cover the rear part of the first insulator 15 and the rear part of the peripheral shell 14 has the pair of flat insulator outer surfaces 17A each of which forms a substantially same plane with the corresponding shell outer surface 14H of the peripheral shell 14, and the ground plates 22 are individually disposed between the peripheral shell 14 and the first contacts 12 and between the peripheral shell 14 and the second contacts 13, the thin connector 11 can be realized.

Since the first contacts 12 integrally held by the first-contact insulator 20 and the second contacts 13 integrally held by the second-contact insulator 21 are joined to the first insulator 15 in which the mid-plate 16 is embedded, and the second insulator 17 is formed with the pair of ground plates 22 and the peripheral shell 14 being disposed on the first insulator 15, the high-precision connector 11 can be formed even when a large number of small first contacts 12 and second contacts 13 are used.

In the connector 11, as illustrated in FIGS. 2 and 5, from the surface facing the −Z direction of the second insulator 17, the pair of shell-side board connecting sections 14D of the peripheral shell 14 and the pair of shell-side board connecting sections 18D of the back shell 18 project, and the recesses 22C of the three arm sections 22F of the ground plate 22 disposed on the −Z directional side are exposed. In this state, the pair of shell-side board connecting sections 14D of the peripheral shell 14 and the pair of shell-side board connecting sections 18D of the back shell 18 are soldered to the associated connection pads on a board B in an electronic device and brought to ground potential, and the +Y directional ends 22B of the three arm sections 22F of the ground plate 22 disposed on the −Z directional side are soldered to the associated connection pads on the board B and brought to ground potential, whereby the metal members including the mid-plate 16, the pair of ground plates 22, the peripheral shell 14 and the back shell 18 are to be at ground potential. Since the first contacts 12 and the second contacts 13 are surrounded by these metal members, it is possible to carry out reliable signal transmission while influence of electromagnetic waves can be reduced. When the +Y directional ends 22B of the arm sections 22F of the ground plates 22 are soldered to the associated connection pads on the board B, the recesses 22C of the arm sections 22F each work as a receiver where a solder fillet is formed.

Since the contact-side waterproof shaped sections 12E and 13E are individually formed around the surfaces of the fixing sections 12C and 13C of the first contacts 12 and second contacts 13, which fixing sections 12C and 13C are to be embedded in the second insulator 17; the ground plate-side waterproof shaped sections 22G are individually formed in the arm sections 22F of the pair of ground plates 22, which arm sections 22F are to be embedded in the second insulator 17; and the shell-side waterproof shaped sections 14G are individually formed in the pair of arm sections 14C of the peripheral shell 14, which arm sections 14C are to be embedded in the second insulator 17. Therefore, even when water enters along the surface of the first insulator 15 that is exposed in the counter connector accommodating portion 14A, water is blocked by the contact-side waterproof shaped sections 12E and 13E, the ground plate-side waterproof shaped sections 22, and the shell-side waterproof shaped sections 14Q and water is thus prevented from reaching the back part of the second insulator 17.

To improve waterproof efficiency, it is preferable for a groove or protrusion formed in the contact-side waterproof shaped sections 12E and 13E, the ground plate-side waterproof shaped sections 22G, and the shell-side waterproof shaped sections 14G to have a height difference of, for instance, not less than 0.01 mm.

As illustrated in FIGS. 1 and 2, the +Z directional ends and −Z directional ends of the pair of projections 15G of the first insulator 15 are exposed from the second insulator 17. However, since these exposed parts of the projections 15G are located in front of the annular waterproof member 19 fitted in the waterproof member groove 17B of the second insulator 17 in the fitting direction, i.e., on the −Y directional side with respect to the annular waterproof member 19, even when water is leaked from the exposed parts, the entering water is blocked by the waterproof member 19 and is prevented from reaching the back part of the second insulator 17.

The ground plate connecting sections 14J of the peripheral shell 14 to be welded to the shell connecting sections 22A of the ground plate 22 are also located in front of the waterproof member 19 in the fitting direction, i.e., on the −Y directional side with respect to the waterproof member 19. Accordingly, even when water is leaked from the welded parts between the peripheral shell 14 and the ground plate 22, the entering water is blocked by the waterproof member 19 and is prevented from reaching the back part of the second insulator 17.

As illustrated in FIG. 5, since the contact-side board connecting sections 13D of the second contacts 13 are located on the −Y directional side with respect to the contact-side board connecting sections 12D of the first contacts 12, and the rear part of the second insulator 17 is covered by the back shell 18, when the connector 11 is mounted on the board B and the contact-side board connecting sections 13D of the second contacts 13 are soldered to a plurality of connection pads (not shown) on the board B, it is difficult to inspect the solder connection at the contact-side board connecting sections 13D from the +Y direction. In the connector 11 according to the embodiment, however, the opening 18F is formed in the upper surface section 18A of the back shell 18 so as to extend in the X direction and to be located immediately above, i.e., on the +Z directional side with respect to, the contact-side board connecting sections 13D of the second contacts 13. Accordingly, it is possible to readily inspect the solder connection at the contact-side board connecting sections 13D of the second contacts 13 through the opening 18F.

While in the foregoing embodiment, the ground plate 22 disposed on the −Z directional side and the back shell 18 are formed as independent components and are welded and joined to each other, the present invention is not limited thereto and the ground plate 22 on the −Z directional side and the back shell 18 may be integrally formed as a single component.

While in the foregoing embodiment, the first contacts 12 and the second contacts 13 are arranged in two rows separately on both surfaces of the mid-plate 16 to face each other, the present invention is not limited thereto and may be applied to a connector in which a plurality of contacts are arranged in a single row.

The number of contacts is not limited, and it suffices if two or more contacts are joined to the first insulator.

What is claimed is:

1. A connector that is mounted on a board and that has a counter connector accommodating portion opening frontward in a fitting direction, the connector comprising:

a first insulator whose front part is located in the counter connector accommodating portion and whose rear part is located at a rear part of the counter connector accommodating portion;

a plurality of contacts that are joined to the first insulator such that front end portions of the plurality of contacts are exposed at a front part of the first insulator and rear end portions of the plurality of contacts project from the rear part of the first insulator;

a contact insulator that integrally holds the plurality of contacts in a vicinity of the rear end portions thereof;

a ground plate whose front end portion is disposed on a surface of the first insulator in the counter connector accommodating portion, and which extends along the plurality of contacts such that a rear end portion of the ground plate is disposed on a surface of the contact insulator and is connected to the board;

a peripheral shell that is made of metal, that is placed over the first insulator so as to surround a periphery of the front end portions of the plurality of contacts and the front end portion of the ground plate, and that is electrically connected to the ground plate; and a second insulator that is formed so as to cover the rear part of the first insulator, a rear part of the peripheral shell, central parts of the plurality of contacts and a central part of the ground plate, with the rear end portions of the plurality of contacts, the contact insulator and the rear end portion of the ground plate being exposed.

2. The connector according to claim 1, wherein the plurality of contacts each have a contact-side waterproof shaped section to block an entry of water in a portion covered by the second insulator, and wherein the ground plate has a ground plate-side waterproof shaped section to block an entry of water in a portion covered by the second insulator.

3. The connector according to claim 1, wherein the peripheral shell is formed in a tubular shape whose front end portion surrounds the periphery of the front end portions of the plurality of contacts and the front end portion of the ground plate, whose rear end portion is exposed from the second insulator near the contact insulator, and whose central part is covered by the second insulator.

4. The connector according to claim 3, wherein the peripheral shell has a shell-side waterproof shaped section to block an entry of water in a portion covered by the second insulator.

5. The connector according to claim 3, wherein the rear end portion of the peripheral shell exposed from the second insulator has a shell-side board connecting section that is connected to the board.

6. The connector according to claim 1, further comprising a mid-plate that is held by the first insulator through formation of the first insulator, that is disposed near the front end portions of the plurality of contacts and that is electrically connected to the ground plate.

7. The connector according to claim 6, wherein the plurality of contacts include:

a plurality of first contacts that are arranged so as to face a surface of the mid-plate on an opposite side from the board; and a plurality of second contacts that are arranged so as to face a surface of the mid-plate on a side closer to the board, wherein the contact insulator includes a first-contact insulator that integrally holds the plurality of first contacts, and a second-contact insulator that integrally holds the plurality of second contacts, and wherein the ground plate includes a first ground plate which is disposed so as to face the plurality of first contacts and whose rear end portion is disposed on a surface of the first-contact insulator, and a second ground plate which is disposed so as to face the plurality of second contacts and whose rear end portion is disposed on a surface of the second-contact insulator.

8. The connector according to claim 7, wherein the second ground plate has a second ground plate-side board connecting section that is located in front of the second-contact insulator in the fitting direction and that is connected to the board.

9. The connector according to claim 1, further comprising a seamless waterproof member that surrounds a periphery of the second insulator on a rear side in the fitting direction with respect to an electrical connection portion between the ground plate and the peripheral shell.

10. The connector according to claim 9, wherein the peripheral shell has a pair of shell outer surfaces that are flat and face in opposite directions from each other, and wherein the second insulator has a pair of insulator outer surfaces which are flat, and each of which forms a substantially same plane with a corresponding one of the pair of shell outer surfaces.

* * * * *